US006256955B1

(12) United States Patent
Lolley et al.

(10) Patent No.: US 6,256,955 B1
(45) Date of Patent: Jul. 10, 2001

(54) APPARATUS AND METHOD FOR DEBRIS-COLLECTING IN MASONRY CAVITY WALLS

(76) Inventors: Richard A. Lolley, 29 Westview Dr., Sanford, ME (US) 04073; James R. Keene, 31600 Gates Mills Blvd., Pepper Pike, OH (US) 44124; Curtis McCorsley, 33 Beaver Valley Rd., Asheville, NC (US) 28804

( * ) Notice: Subject to any disclaimer, the term of this patent is extended or adjusted under 35 U.S.C. 154(b) by 0 days.

(21) Appl. No.: 09/532,185

(22) Filed: Mar. 20, 2000

Related U.S. Application Data

(63) Continuation of application No. 09/130,405, filed on Aug. 6, 1998, now abandoned.

(51) Int. Cl.[7] ..... E04B 1/70

(52) U.S. Cl. ..... 52/302.3; 52/302.1; 52/310; 52/745.09; 52/742.12

(58) Field of Search ..... 52/396.08, 396.04, 52/302.1, 302.3, 381, 382, 383, 378, 379, 562, 513, 310, 745.09, 741.3, 742.12

(56) References Cited

U.S. PATENT DOCUMENTS

| | | | | |
|---|---|---|---|---|
| Re. 36,676 | | 5/2000 | Sourlis . | |
| 2,071,653 | * | 2/1937 | Nyhagen, Jr. | 52/396.08 |
| 2,705,887 | | 10/1955 | Xanten . | |
| 2,934,931 | | 5/1960 | Johnson . | |
| 3,019,560 | * | 2/1962 | Hansen | 52/513 X |
| 3,288,998 | * | 11/1966 | Press, Jr. | 52/302.3 X |
| 3,500,596 | * | 3/1970 | Andersson | 52/302.3 X |
| 4,852,320 | | 8/1989 | Ballantyne . | |
| 5,230,189 | | 7/1993 | Sourlis . | |
| 5,274,968 | * | 1/1994 | Pardo | 52/310 X |
| 5,343,661 | | 9/1994 | Sourlis . | |
| 5,489,462 | * | 2/1996 | Sieber | 52/302.1 X |
| 5,598,673 | * | 2/1997 | Atkins | 52/302.1 |
| 5,826,390 | * | 10/1998 | Sacks | 52/301.1 X |
| 5,860,259 | * | 1/1999 | Laska | 52/302.3 |

* cited by examiner

*Primary Examiner*—Beth A. Stephan
*Assistant Examiner*—Brian E. Glessner
(74) *Attorney, Agent, or Firm*—Thomas L. Bohan; Patricia M. Mathers

(57) ABSTRACT

A mesh device for retaining mortar and other debris within a mortar-cavity-wall so as to prevent such material from falling in front of and hence blocking the "weep holes" placed at the bottom of such a wall to permit the egress of moisture condensate that forms within this type of wall. The device of the present invention is a rectangle of thin, openly woven mesh of basically a planar shape but with "bumps" distributed across the plane in such manner that when the device is placed upright within the cavity the bumps form barriers to the dropping of mortar and other debris. The bumps themselves, being made of the same material as the rest of the device, are fully permeable to moisture working its way down the cavity. Furthermore, there is an offset of the bumps in one row from those in the next so as to further reduce the possibility of a blockage occurring, say by debris accumulated on the bumps. Finally, the bumps on one side of the planar surface are matched by "dimples" on the other side. This permits nesting of the individual devices, thus reducing the space that the units take up during transportation and storage.

16 Claims, 5 Drawing Sheets

APPARATUS AND METHOD FOR DEBRIS-COLLECTING IN MASONRY CAVITY WALLS

This is a continuation of application Ser. No. 09/130,405, filed Aug. 6, 1998, which is now abandoned.

BACKGROUND OF THE INVENTION

1. Field of Invention

The invention relates to the field of masonry construction. In particular, the invention relates to the field of construction of masonry "cavity" walls having an inner structural wall and an outer veneer wall and an air-space cavity between the structural wall and the veneer wall. More particularly, the invention relates to the problem of relieving moisture build-up in the air-space cavity by providing for adequate continuing drainage of moisture condensate to the outside of the outer wall. More particularly still, the invention relates to a device for preventing the obstruction of drainage weep holes in masonry cavity walls by wet and dry mortar and other construction debris during and after construction and to a method for use of such a device in masonry cavity wall construction.

2. Prior Art

In the field of masonry cavity wall construction, it is well know that moisture, largely in the form of condensation, tends to form and collect in the cavity between the inner construction wall and outer veneer wall. In general, the inner wall of a cavity wall construction is the load-bearing element and may be made of masonry block, framed in wood, or framed in metal; typically it has an innermost surface of wallboard, wood paneling, or tile. The outer veneer wall is usually made of mortared brick or masonry stone. In general, the inner, load-bearing wall is constructed first, and the outer veneer wall afterward. The distance between the inner and outer walls forming the air-space cavity is typically from one inch to three inches. Moisture, if allowed to collect and remain in the air-space cavity, will lead to a number of undesirable effects in the construction materials ranging from cosmetic discoloration to rot and disintegration leading to structural weakening.

Moisture accumulation in cavity-type walls is a well-known problem. (See, e.g., U.S. Pat. No. 2,147,035 issued to Henderson in 1939, which teaches drains installed within walls made of hollow-core masonry block.) Awareness of this problem has lead to the nearly universal practice of constructing such walls to have a number of drainage weep holes leading from the air-space cavity to outside of the outer veneer wall. Such weep holes are left along the base of the wall and also along the tops of doorways, window openings, and other breaks through the wall that create surfaces where moisture condensate may collect.

In general, weep holes are simply gaps in the mortar beneath the bottom course of brick and/or between some of the adjacent bricks in the bottom course. In some instances the holes may be lined with tubing or may be created by a device built into the structure, such as the weep hole form taught by Johnson (U.S. Pat. No. 2,934,931 issued 1960), which includes some minimal protection against debris clogging the formed weep hole. However, such weep-hole forms tend to be expensive and, being usually of metal, tend to corrode. The installation of such forms also adds an extra step in the building process, increasing labor costs; thus, they are not often employed.

Regardless of the method used to provide weep holes, however, it is the primary purpose of such weep holes to provide a path for drainage of condensate from the within wall cavity to the outside. Since intrusion of water vapor both though the weep holes, but principally though gaps, cracks, and cuts, however tiny, provides a continually renewing source of moisture condensate, it is accepted as essential that the drainage weep holes remain unobstructed over the life of the wall. Thus, a number of devices and methods have been taught that deal with keeping the weep holes clear and functional as drainage passages.

Sources of weep-hole-obstructing debris are present during construction and also after construction. During construction the primary source of such debris is excess, wet mortar squeezed from between courses of bricks as they are being laid. Wet mortar that exudes from between courses on the outside of the wall is removed by scraping it away with the mason's trowel; that which is extruded from between courses on the inside, however, cannot be so removed, due to the narrowness of the air-space cavity, and some of it will fall to the bottom of the cavity where the weep holes are. Also other construction debris, such as wall board trimmings, sawdust, and nails, may fall between the inner and outer walls into the air-space cavity during construction.

Early solutions to this problem depended on applying a secondary use of wall ties. Wall ties were usually made of metal rod worked into various shapes and designs that were attached (in a masonry wall by being mortared between courses) to both the inner and outer wall to tie the walls together. Such a wall-tie-dependent device was disclosed by Xanten (U.S. Pat. No. 2,705,887 issued 1955), in which the wall tie was formed to provide a bight in the cavity between the walls to hold in place a V-shaped trough of sufficient length to span two or more such ties. The troughs, having handles by which they could be removed from above, would be set across previously installed wall ties, below the site where bricks were then currently being laid, to catch the wet mortar and other debris falling into the cavity during construction. The troughs would then be extracted, emptied, and moved as work progressed. Obviously, however, this process created a number of extra work steps, added significantly to construction time and labor costs, and provided no continuing protection after construction was complete.

A later scheme of Ballantyne (U.S. Pat. No. 4,852,320 issued in 1989) provides for a plurality of individual mortar-collecting devices to be set on or installed with wall tie members. The upper surface of each device is inclined sufficiently to allow water to run off, but no so severely as to permit wet mortar to slide off. The devices are installed adjacent to the inside of the mortared wall and spaced in staggered rows, so that no vertically clear path remains for mortar to fall without hitting at least one of the devices. While they were effective in catching wet mortar, however, such devices were ineffective in preventing the excursion of dry debris to the bottom of the cavity during and after construction. Also, in order to provide sufficient protection along the length of the wall, either a large number of small devices, or a smaller number of larger devices of this type are required. This requirement not only adds steps—thus increasing time and labor costs—to the construction process, but also increases construction material costs. This increase in material cost is exacerbated, currently, because modern construction techniques have made wall ties largely unnecessary in cavity wall construction, making such wall-tie-dependent devices especially undesirable.

New materials provide alternatives both to expensive mechanical solutions to debris collection and to dependence on particular construction features, and may obviate the necessity of additional construction steps. One such class of materials consists of a non-woven coarse mesh of polymer fiber. Such non-degradable fibers tend to maintain their shape and strength characteristics over time under the range of normal environmental conditions, and a non-woven mesh of sufficient coarseness does not interfere with air circulation nor impede the flow of condensate, but provides an interfering matrix of fibrous collectors sufficient to catch and hold both wet and dry debris produced both during and after construction. A number of devices and methods employing such materials have been set out.

A system of weep hole obstruction prevention in masonry cavity walls disclosed by Atkins (U.S. Pat. No. 5,598,673 issued in 1997) teaches that the entire air-space cavity of a cavity wall be filled with the type of non-woven mesh described above. This system is obviously effective in preventing the introduction of all types of construction and post construction debris to the bottom of the air-space cavity to obstruct the flow of condensate through the weep holes. However, the system of Atkins requires the use of a massive amount of mesh material. As with previously described devices and methods, this requirement greatly increases construction material costs, not only from the amount of mesh material needed, but also from the need to affix the mesh material to a solid backing sheet material in order to support the mesh and maintain its vertical dimension to be coincident with the vertical dimension of the wall. Further, installation of this system increases labor costs.

Another system for the prevention of the accumulation of debris from weep holes disclosed by Laska (U.S. Pat. No. 5,860,259; 1999) teaches the use of an insulating layer in conjunction with a matting or, alternatively, with a solid plastic material. While Laska teaches that the matting may be made from strands of polymer or copolymer, the only structure disclosed for this matting is a complete filling of the space between the outer with and the insulating layer. This construction is similar to that of Atkins with the addition of an insulating layer in the space between the wythes. Besides the added cost of filling the entire void with fiber, falling mortar readily accumulates along the top edge of the matting in this embodiment of Laska. As a result, the draining function of the system is frustrated.

Laska also teaches a drain section made from a solid plastic having a "waffled" cross-section. Because the majority of the depth of the space between wythes is filled by the insulating layer, the drain function is highly dependent on the void space occupied by the protrusions. If the diameter of protrusions is too wide, then the mortar falling into the drain will bridge the gaps between the protrusions. Because the volume of the inter-wall space is substantially filled by the insulating layer, the volume of mortar falling into the drain is forced to move parallel to the walls to a greater degree than if the insulating layer was absent. Consequently, an upper limit exists on the percentage of void space that the solid-plastic waffle-protrusions can occupy. If this limit is exceeded the drain function markedly decreases, or even ceases all together. Laska is, by practicality, constrained to using protrusions that slope downward or are rounded so as to prevent bridging.

The inventor of the present invention has used non-woven polymer-fiber mesh filter material to address the problem under discussion. Using sheets of such material—as are shown in FIG. 1 (Prior Art)—having thicknesses less than the width of the air-space cavity and installed to various heights above the weep holes, the inventor reached three significant conclusions:

(a) as a practical matter, it is not necessary to extend the debris-blocking action to heights greater than 9 to 18 inches above the weep holes;

(b) readily-available non-woven polymer-fiber mesh material has more than sufficient strength to maintain its own shape under the weight of the greatest amount of debris that could be expected to load it in a mortar wall, that is that there was no need for external support such as would be provided by affixing a solid backing to the mesh or by making the sheet thickness equal to the depth of the cavity;

(c) this mesh material is readily available in mesh densities sufficient to prevent penetration by construction and post-construction debris while continuing to provide for the free flow of moisture condensate and air.

Also, the inventor observed from his work that construction debris can easily be removed manually until the height of the outer veneer wall reaches about 9 to 18 inches above the base location of the weep hole, the height depending on the depth—i.e., the distance between the inner and outer walls—of the particular air-space cavity. This meant that the debris-blocking device did not have to be installed until after the construction had passed this height. This meant in turn that the masons do not have to contend with the presence of the mesh or other device immediately abutting the area of the wall that they are working on.

After the outer veneer wall has been raised to a height of 9 to 18 inches, the sheet is set into the cavity so that its lower edge is against the inner wall and its upper edge then leans against the outer wall, as shown in FIG. 1 (Prior Art). Experience with this configuration has shown that, properly installed, it provides more than sufficient debris-collection surface area. This means that its permeability to liquid condensate (and air) is not significantly affected even after it has caught, and therefore accumulated, its full load of debris. Nevertheless, it can be installed incorrectly relatively easily, namely by placing its bottom end against the weep-hole side of the bottom plane rather than the opposite side. This means that a certain level of supervisory oversight must be maintained to ensure proper installation, as is always true when it is possible to install something incorrectly. Furthermore, these extended mesh bodies, having uniform thickness as well as width and depth, take up a significant volume during transport and storage.

Mortar debris collection devices disclosed by Sourlis (U.S. Pat. No. 5,230,189 issued in 1993) ["Sourlis I"] and Sourlis (U.S. Pat. No. 5,343,661 issued in 1994) ["Sourlis II"] generally employ one or more non-woven fiber mesh sheets that together have a thickness equal to the depth of the air-space cavity. While Sourlis I and Sourlis II teach devices and systems which are generally installed within the bottom of the airspace cavity to a height of only several courses of brick or masonry stone veneer wall, some of those applications require that the sheets be cut to specific shapes, others require additional mounting devices, and still others disclose systems of mechanical projections that must be mechanically affixed to or through solid backing materials. In every case, the Sourlis I and Sourlis II devices require a number of fabrication and/or installation operations that increase both the cost of the devices and the cost of time and labor required to install them. Also, the bulk of these devices require substantial shipping and storage resources.

What is needed is, then, is a debris-collecting device for preventing the obstruction of weep holes that is less expensive to install than are the prior art devices. What is further needed is such a debris-collecting device that requires less space during transportation and storage than do the prior art devices. What is yet further needed is such a debris-collection device that can be installed within masonry cavity walls with no need for supervisory oversight to ensure that it is installed properly.

SUMMARY OF THE INVENTION

The mesh device of the present invention is inexpensive to manufacture, requires no installation steps beyond dropping it into the masonry wall cavity, is of such a shape that a smaller mass of mesh can accomplish the same debris-blocking task of earlier "full-width" mesh blocks. Furthermore, it is of a nestable shape so that an unlimited number of the individual mesh units may be nested together for shipping and storage.

The device of the present invention is made up of thin sheets of non-degradable, non-absorbent fiber mesh screen. The essence of the invention is the manner in which these sheets are shaped. Basically planar, the sheets have arrayed over their entire surface blisters that create convex nodes on one side of the sheet and concave dimples on the other side. Viewed from the node-side, one of these sheets looks like a plane with an array of isolated mounds.

The device of the present invention utilizes a mesh density—defined in terms of the average space between fibers—that is sufficiently large to permit the free passage of moisture condensate and air while being sufficiently small to prevent penetration by falling mortar and other construction debris large that could obstruct the cavity weep holes. The fiber-mesh screen is fabricated into sheets preferably 9 to 18 inches wide and in lengths to meet standard construction needs—e.g., four and eight feet. On a given sheet, the nodes all extend to the same distance "above" the plane of the sheet, the distance being chosen to equal the depth of the air-space cavity in which the screen sheets are to be used. Preferably, the nodes are molded so as to be integral impressions in the fiber-mesh sheet; thus, an advantage of the present invention is ease of fabrication.

The described nodes are made large enough and structurally strong enough to effectively block and collect drops of extruded wet mortar and of other construction debris large enough obstruct a cavity wall weep hole. They are arranged in a pattern such that, with the sheet installed vertically within a masonry cavity wall, debris falling within the cavity where the sheet is installed must encounter at least one node. Thus a further advantage of the present invention is its effective protection of cavity wall weep holes from obstruction using a minimum of material.

The arrangement pattern and uniform dimensions of the nodes are such that, when the sheets are laid one on top of another for storage or shipping, the convex nodes of one sheet will insert into and nest within the concave dimples of the next, allowing the flat surfaces of the fiber-mesh sheets to lie adjacent. Thus a stack of such sheets laid one on top of another has the still further advantage of requiring a minimum of space, resources, and expense related to shipping and storage.

Unlike the situation of the best of the prior art devices, the installation of the device of the present invention requires no supervisory oversight. One simply drops the node-covered mesh sheet into the air-cavity so that the flat screen surface of the fiber-mesh sheet lies vertically flush against the surface of one of the walls. The lower edge of the sheet, which typically corresponds to the sheet's long dimension, rests on a base of the air-space cavity, on the plane which the weep holes ultimately drain. Preferably, a single sheet is placed at this base of the air-space cavity, extending above and across the weep holes to be protected. However, nothing in this specification limits the height or length within a cavity wall air-space cavity to which the present invention may be extended. Where additional protection of weep holes is considered necessary, additional sheets of the present invention may be installed side by side, or may be installed one above the other to any required height. Such upward installation may require that a plurality of sheets be affixed to an effectively rigid backing sheet; in most such installations, however, the sheets may usually be attached directly to the wall by those fastening means that builders ordinarily have on hand, such as staples, nails, and epoxy cement.

Since the extension of the nodes above the mesh sheet's planar part is substantially equal to the depth of the air-space cavity—i.e., equal to the distance between the inner and outer walls—the tips of the nodes contact the opposite wall and hold the device vertically in place. Thus, yet another advantage of the present invention is that installation requires no tools and no special consideration that would require additional supervisory oversight.

Also, the device may be installed, and is held securely in place, early in the construction of the veneer wall, typically as soon as two or three courses of brick—or similar height of masonry stone or other construction material—is laid where the device is to be placed. This affords the still further advantage to the present invention of allowing workers and supervisors to visually confirm the placement of the device as construction of the veneer wall continues, and also ensures that weep-hole-protection is available from the earliest stages of construction.

It is well known in the field of cavity-wall construction that it is not essential to protect with special devices all of the weep holes in an entire cavity wall construction. Thus, the screen sheets of the present invention may be cut and installed in smaller sections that protect one or some small number of such weep holes. In such applications, it is an advantage of the present invention—whether its fiber is constructed of polymer fibers, of corrosion-resistant metal fibers, or fibers of some other material having similar characteristics—that the screen sheets can be cut on the job site, as needed, usually with ordinary scissors, or at least with such shears as masons ordinarily have on hand to cut hardware cloth and flashing material. In the alternative, however, the device of the present invention uses so little material relative to prior art devices, and thus is so inexpensive relative to prior art devices, that use of the device along the entire length of all of the bases of a cavity wall construction as would benefit from weep-hole-obstruction protection is an economically reasonable application of the device described herein.

PREFERRED EMBODIMENT OF THE INVENTION

Figure 1:
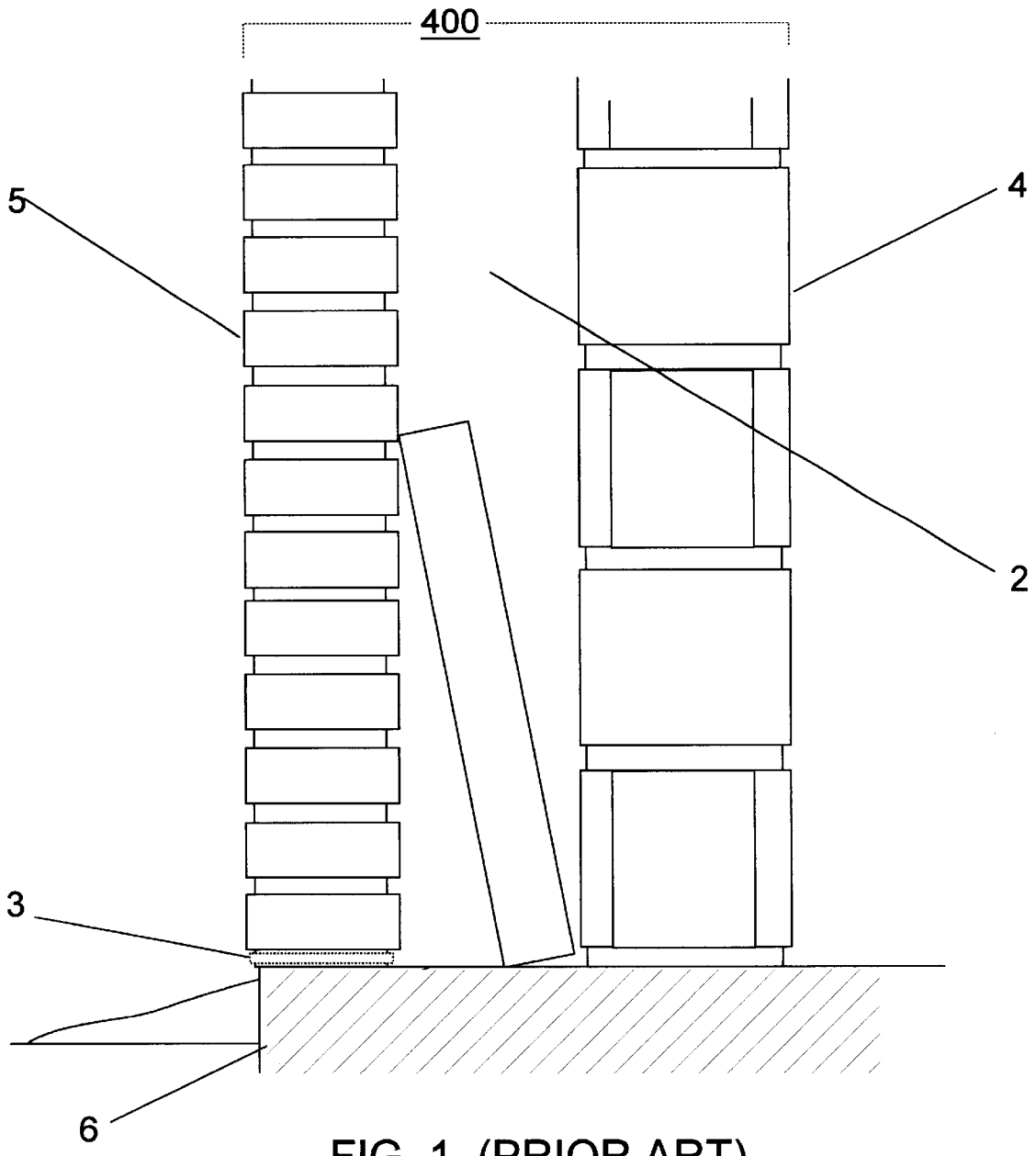
FIG. 1 (PRIOR ART)
FIG. 1 (Prior Art) illustrates a device used and sold by the inventor of the present invention.
Figure 2:
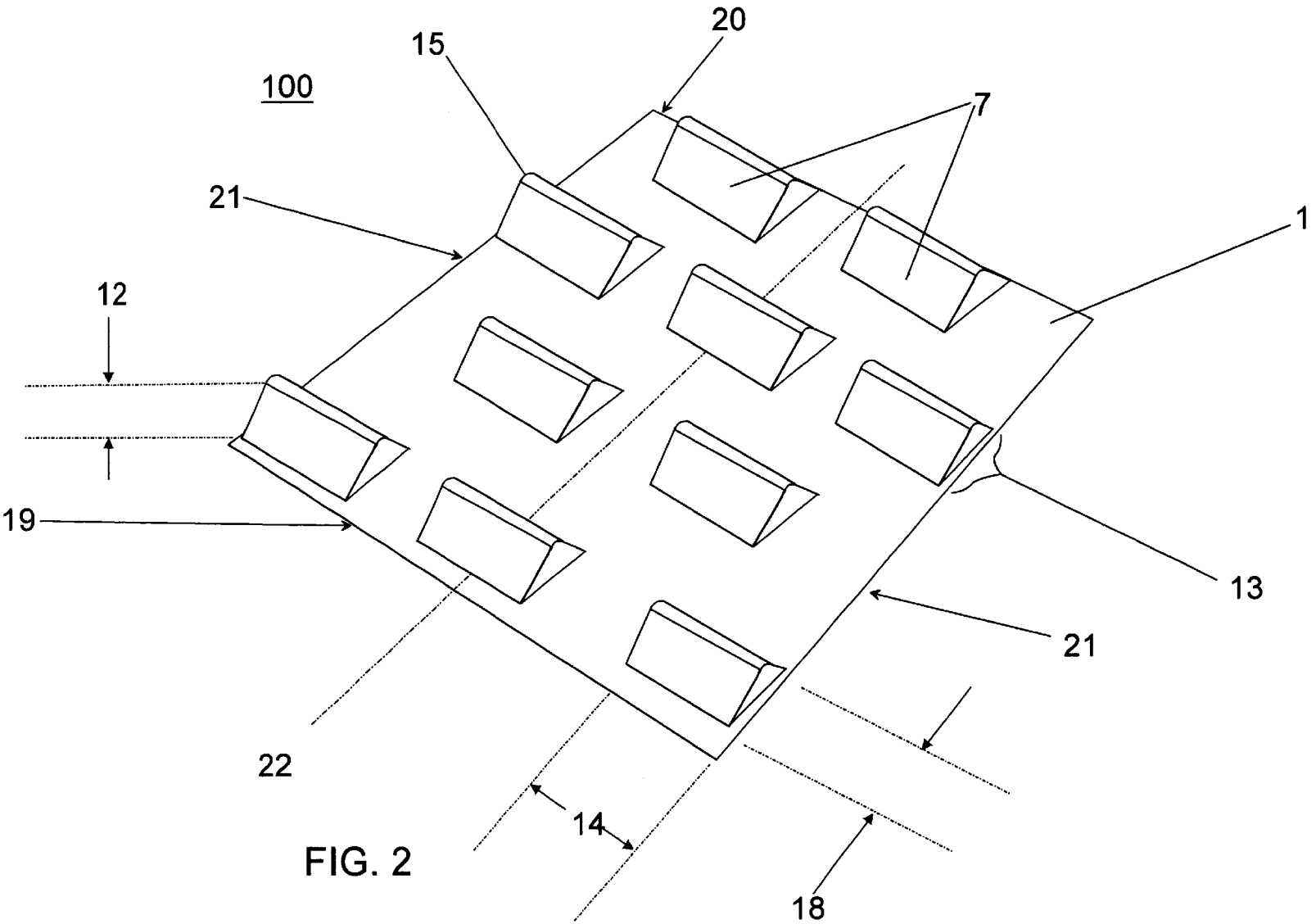
FIG. 2 is an isometric view of a sheet of molded non-woven fiber screen of the present invention showing hollow molded nodes distributed in one of a number of possible arrangements.
Figure 3:
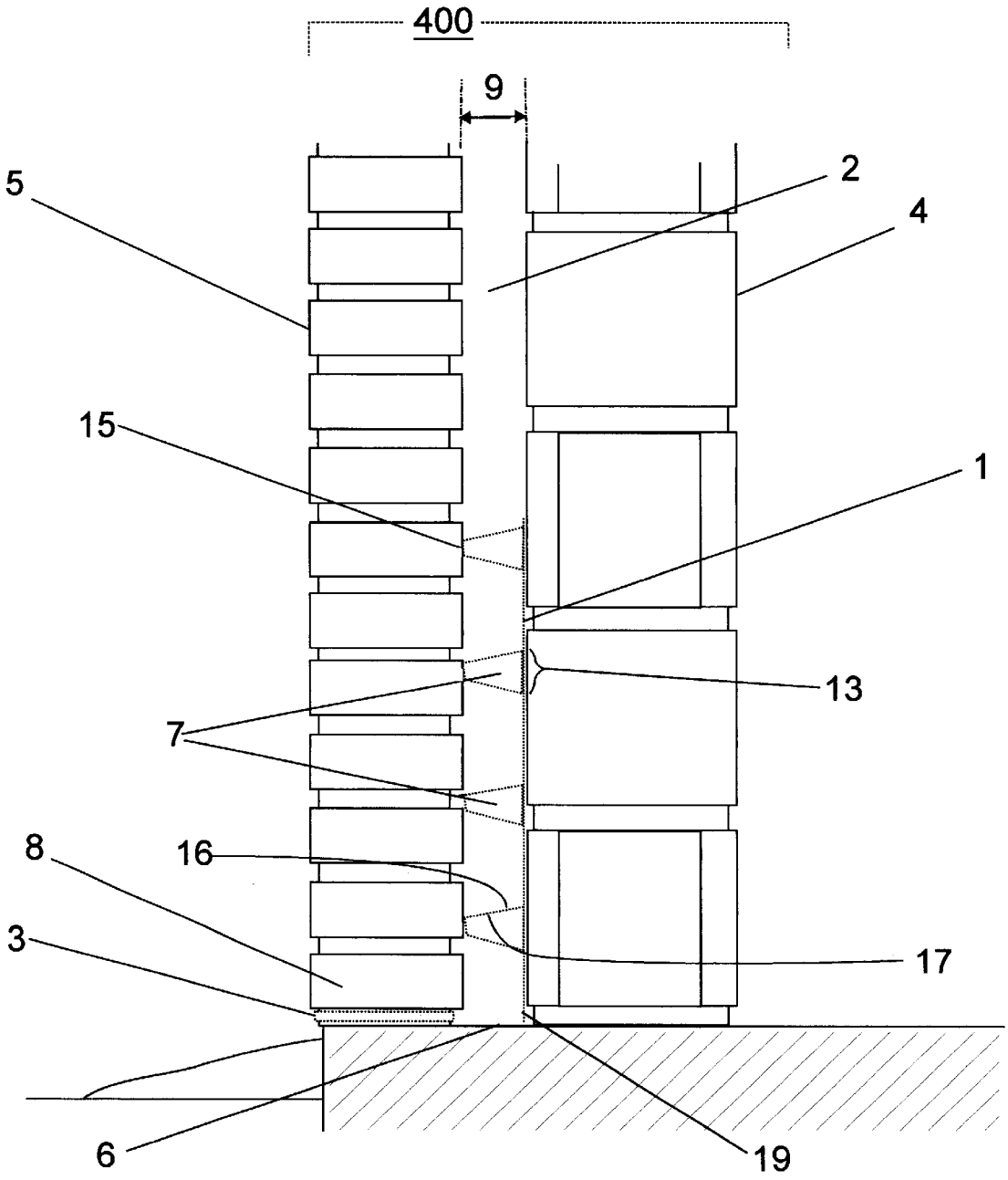
FIG. 3 is a cutaway profile view of a typical cavity wall showing the device of the present invention installed in the air-space cavity between an inner load-bearing wall and an outer veneer wall.
Figure 4:
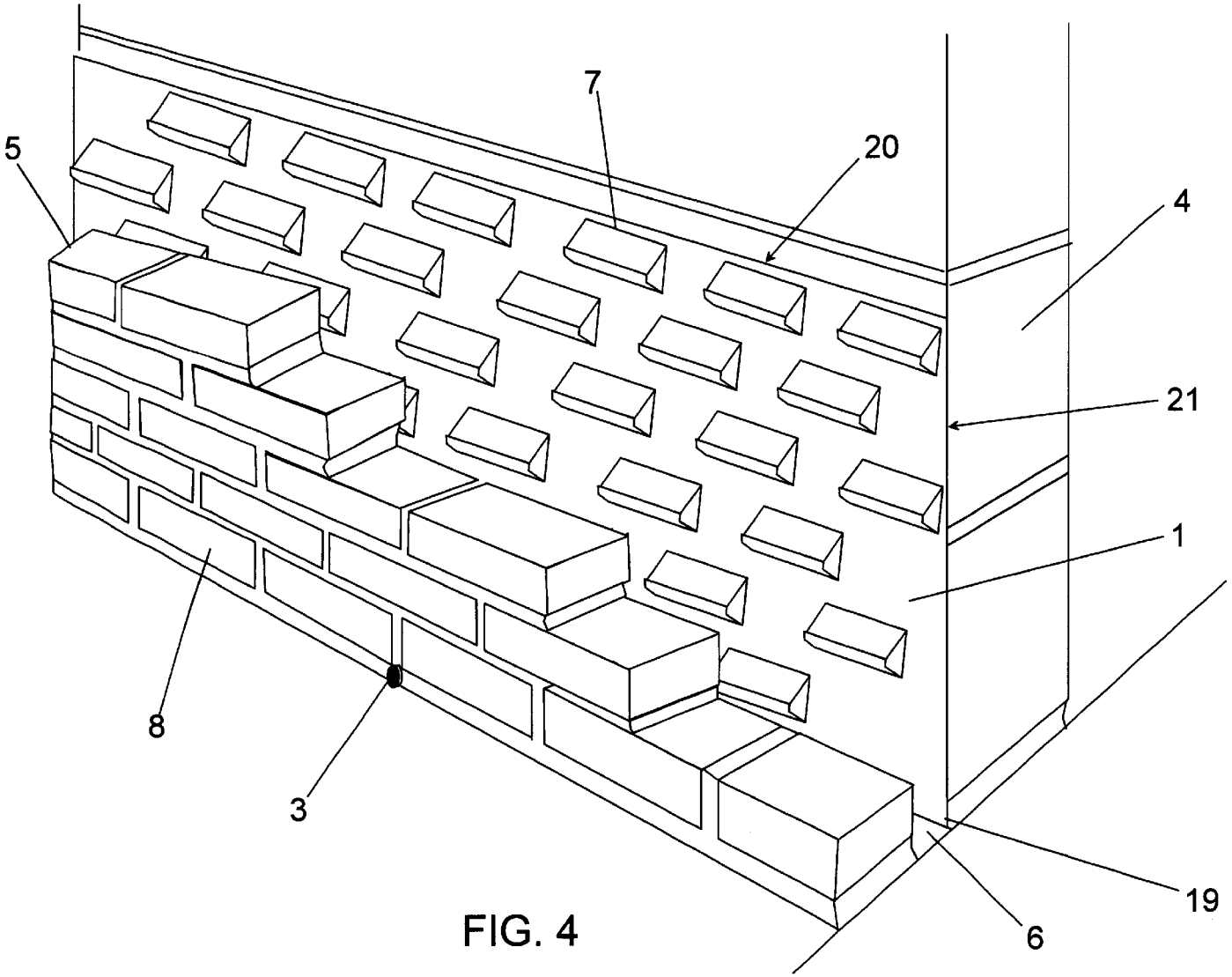
FIG. 4 is a cutaway isometric view of a typical cavity wall under construction showing the device of the present invention installed in the air-space cavity between an inner load-bearing wall and an outer veneer wall.

By referring to FIG. 2, FIG. 3, and FIG. 4, it can be seen that the apparatus of the Preferred Embodiment of the present invention is one or more molded debris-collection devices 100 deployable within an air-space cavity 2 of a masonry cavity wall 400. Its purpose is to protect from debris-blockage one or more weep holes 3. The masonry cavity wall 400 consists of an inner load-bearing wall 4 and an outer veneer wall 5, the planes of which walls are essentially parallel to each other. The air-space cavity 2 consists of all of the space between the inner load-bearing wall 4 and the outer veneer wall 5. The air-space cavity 2 has a cavity depth 9 established by the inner load-bearing wall 4 and the outer veneer wall 5. Although said cavity depth 9 varies from one masonry cavity wall 400 to another and typically equals 1 to 3 inches, it is constant to a reasonable tolerance within a particular masonry cavity wall 400.

With continued reference to FIG. 3, it is seen that the masonry cavity wall 400 is erected vertically upon a horizontal base surface 6, which generally forms a foundation of a structure. However, the base surface 6 is also formed elsewhere in the masonry cavity wall 400, namely wherever a break occurs through both the inner load-bearing wall 4 and the outer veneer wall 5, as for a window or a door. In such instances, the base surface 6 is formed by a top piece of wall-breaking construction, such as a door lintel.

The weep holes 3 are left at the base of the outer veneer wall 5 to provide a path for moisture—generally condensed water vapor—to pass out of the air-space cavity 2, and also to provide for air circulation and equalization of air pressure between the air-space cavity 2 and the outside. The weep holes 3 are usually gaps left in the mortar between the base surface 6 and a first course 8 of brick or masonry stone laid on the base surface 6. The weep holes 3 may be lined, as with tubing, and are typically spaced at regular intervals along the base surface 6.

Figure 5:
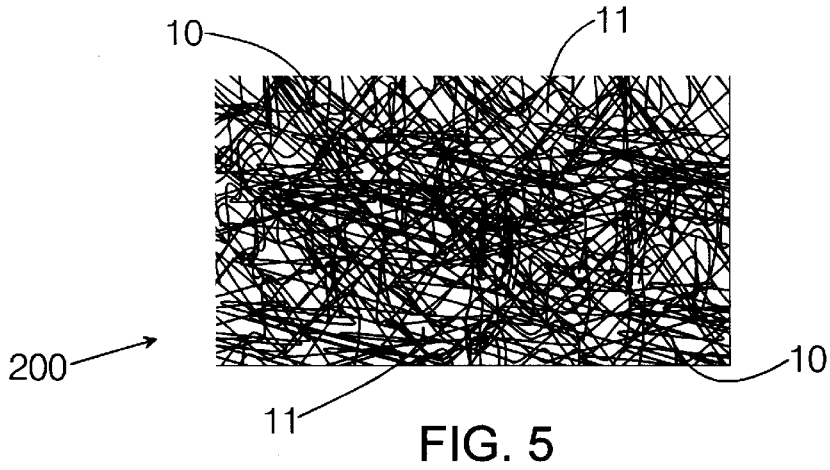
FIG. 5 illustrates the random screen pattern of non-woven fiber mesh.

As illustrated in FIG. 5, the molded debris-collection device 100 of the present invention is preferably made from a single mesh sheet 200 of non-woven polymer fibers 10—although fibers of any non-absorbing material of sufficient strength and plastic characteristics, such as glass or metal, may be employed, and the mesh may be woven. The mesh sheet 200 is preferably of thickness not more than that of two to three overlaid fibers 10, typically less than 1/16 (one-sixteenth) inch in all. The fibers 10 of the mesh sheet 200 form a patterniess array with randomly spaced and randomly arranged gaps 11 with an average greatest dimension of, preferably, less than about 1/16 (one-sixteenth) inch, and a maximum dimension not greater than about 3/16 (three-sixteenths) inch. Forming of the molded debris-collection devices 100 of the present invention is preferably accomplished during the same pressing operation that initially forms the mesh sheet 200.

However formed, the molded debris-collection devices 100 of the present invention consist of an essentially flat sheet surface 1 into which have been formed a plurality of hollow molded nodes 7, each extending to an extension tip 15 that is a predetermined, uniform extension distance 12 from the sheet surface 1. The extension distance 12 of the molded nodes 7 is approximately equal to the cavity depth 9 in which the molded debris-collection devices 100 are to be installed. Each of the molded debris-collection devices 100 is essentially rectangular in overall shape, having a lower edge 19 and an essentially parallel upper edge 20 of approximately equal length defining a horizontal dimension and two vertical edges 21 essentially perpendicular to the lower edge 19 and the upper edge 20 defining a vertical dimension such that preferably the horizontal dimension is greater than the vertical dimension.

Figure 6:
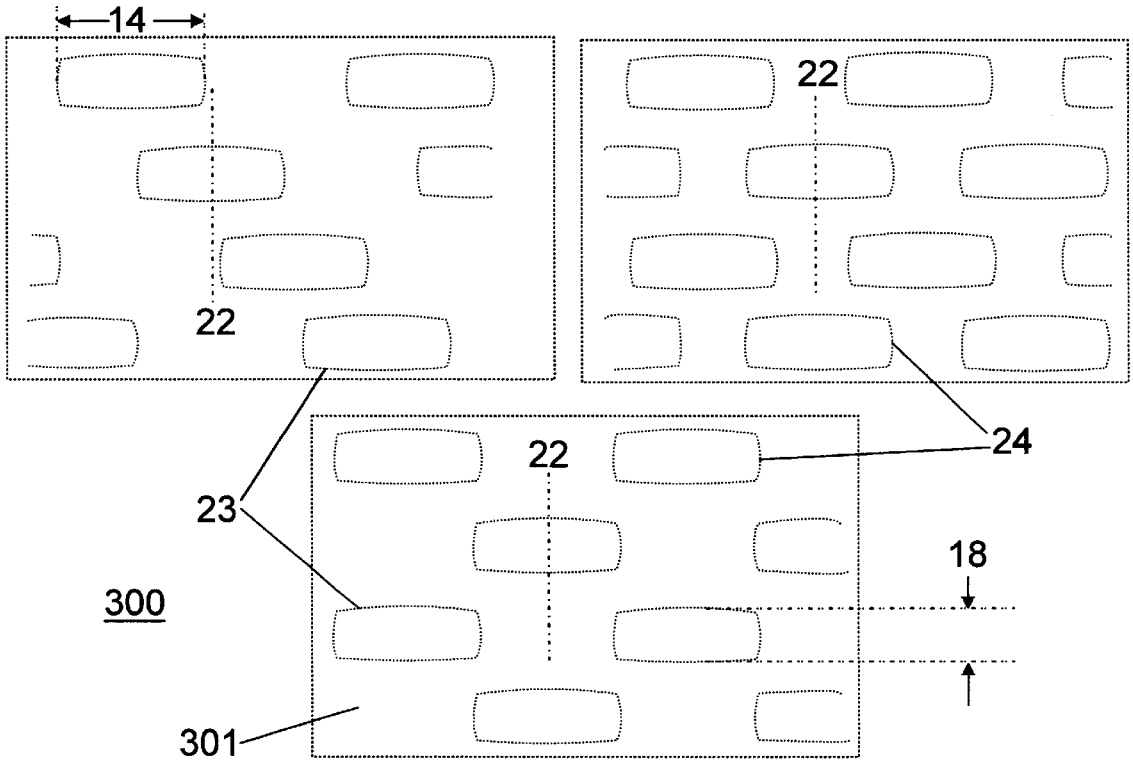
FIG. 6 shows several possible arrangements of the nodes on a sheet of non-woven fiber mesh as may be used in the present invention.

As is shown in FIG. 6, each of the molded nodes 7 has an essentially rectangular base 13 on the sheet surface 1, with a node-horizontal dimension 14 parallel to the lower edge 19 and a node-vertical dimension 18, where in the Preferred Embodiment the node-horizontal dimension 14 is greater than the node-vertical dimension 18. Thus, each of the molded nodes 7 has a horizontal side 23 of node horizontal dimension 14 and a vertical end 24 of node vertical dimension 18. Preferably, the node-horizontal dimension 14 and the nod- vertical dimension 18 are uniform throughout all of the molded nodes 7 of the molded debris-collection devices 100. Further, in the Preferred Embodiment, each of the molded nodes 7 has a triangular or trapezoidal profile shape, as shown in FIG. 3, such that the rectangular base 13 is significantly greater in size than the extension tip 15. The profile shape is preferred for the structural augmentation it affords against buckling of the molded nodes 7 under load. Each of the molded nodes 7, having been pressed out from the original non-woven mesh sheet 200 in the manufacture of the molded debris-collection device 100 of the Preferred Embodiment, has a convex outer surface 16 forming the node and a concave inner surface 17 forming a dimple.

The molded nodes 7 are arranged over the entire sheet surface 1 in a plurality of horizontal node rows, each horizontal node row being parallel to the lower edge 19 and parallel to all other horizontal node rows. Each of the horizontal node rows is arranged with respect to each proximate (nearest) horizontal node row so that a vertical centerline 22 of each of the molded nodes 7 in one row does not intersect the rectangular base 13 of any of the molded nodes 7 in the proximate horizontal row above or below, but so that at least one vertical line projected from and being congruent with a vertical end 24 of the rectangular base 13 of each of the molded nodes 7 does intersect at least one of the molded nodes 7 in at least one proximate horizontal row. That is, the arrangement of molded nodes 300 is such that at least one vertical end 24 of each of the molded nodes 7 vertically overlaps the vertical end 24 of at least one other of the molded node 7 in at least one proximate row; in the preferred arrangement 301 of the Preferred Embodiment of the invention, each vertical end 24 of each of the molded nodes 7 overlaps one vertical end 24 of another of the molded nodes 7 in each proximate row. Thus the arrangement of molded nodes 300 is such that no vertical line perpendicular to the upper edge 20 of the molded debris-collection device 100 can be extended to the lower edge 19 of the same device without intersecting at least one of the molded nodes 7. Further, the arrangement of molded nodes 300 is preferably made, among a particular lot of such molded debris-collection devices 100, so that, if two molded debris-collection devices 100 are placed side-by-side so that the vertical edge 21 on the right side of one such device is set adjacent to the vertical edge 21 on the left side of the other, the same arrangement of molded nodes 300 will be carried over from one device to the other.

Further still, the arrangement of molded nodes 300 is uniform among a particular lot of molded debris-collection devices 100 intended for the same job, and, preferably, among all such molded debris-collection devices 100 manufactured for the same general use within the field of cavity wall construction. In this way, a number of molded debris-collection devices 100 may be laid one on top of the other so that the convex outer surface 16 of each of the molded nodes 7 of each molded debris-collection device 100 fits within the concave inner surface 17 of each of the corresponding molded nodes 7 of the next adjacent device so that the sheet surfaces 1 of each of the molded debris-collection devices 100 lie closely adjacent to the next, thus creating a substantial savings in the space required to store a large number of such uniformly manufactured molded debris-collection devices 100.

The molded debris-collection device 100 of the present invention is emplaced into the air-space cavity 2 of a masonry cavity wall 400, as illustrated in FIG. 3, preferably so that sheet surface 1 of the device lies flush against the surface of the inner load-bearing wall 4, the extension tip 15 of each of the molded nodes 7 are in contact with the outer veneer wall 5, and the lower edge 19 of the device rests on the base surface 6 of the air-space cavity 2 on the same plane as that of the weep holes 3. The molded debris-collection device 100 is placed into the air-space cavity 2 of a masonry cavity wall 400 in the manner described so that one vertical edge 21 of the molded debris-collection device 100 stands to either side of at least one weep hole 3 and the horizontal dimension of the lower edge 19 spans at least one weep hole 3. Thus, a plurality of molded nodes 7 arranged as above-described is set above at least one weep hole 3. Such installation of the molded debris-collection device 100 may be effected as soon as the outer veneer wall 5 has been raised to a height greater than the distance of at least one horizontal row of molded nodes 7 from the lower edge 19 of the device. An affixing means is not required. The fit of the sheet surface 1 of the device against the surface of the inner load-bearing wall 4 and the extension tip 15 of each of the molded nodes 7 against the outer veneer wall 5 is sufficient to hold the molded debris-collection device 100 in place and to keep the device in its proper position for collection of construction debris and protection from obstruction of the thus-protected weep-hole 3.

What is claimed is:

1. An apparatus adapted to collect and retain debris within a masonry-cavitywall made up of an inner wall having a first interior wall surface, an outer wall having a second interior wall surface, and an air-cavity between said first interior wall surface and said second interior wall surface, said air-cavity having a cavity-depth defined by a separation between said first interior wall surface and said second interior wall surface, said apparatus comprising:

a planar sheet of fibrous mesh screen, said mesh screen being fabricated from a nonabsorbent, non-degradable material, said planar sheet having a first sheet surface and a second sheet surface, said planar sheet further being substantially quadrilateral; and a plurality of nodes disposed on said sheet, wherein each node of said plurality of nodes has a node tip, a node width, a node depth, and a node height, wherein said node width is defined by a width of a pair of substantially planar node surfaces and said node depth by a distance that said planar node surfaces extend outward from said first sheet surface to said node tip, wherein said node depth is adapted to be substantially equal to a cavity depth in a masonry-wall cavity, wherein said pair of substantially planar surfaces includes an upper planar surface and a lower planar surface, wherein said node has a node base on said first sheet surface, and wherein said upper planar surface and said lower planar surface extend outward from said base and slope toward each other toward said node tip, and wherein said node forms a recess on said second sheet surface.

2. The apparatus of claim 1, wherein said plurality of nodes is arranged in an array of rows, each of said rows containing at least one node, and wherein each one of said rows is substantially parallel to all other of said rows.

3. The apparatus of claim 2, wherein said nodes are evenly spaced across each of said rows.

4. The apparatus of claim 3, wherein said nodes are arranged in said rows such that a line drawn from a center of any said node tip in a first row of said array to a center of any said node tip in an adjacent row is not perpendicular to said rows.

5. The apparatus of claim 1, wherein said planar sheet has a thickness of less than 1/16 inch.

6. The apparatus of claim 5 wherin said fibrous mesh screen comprise a patternless array of gaps, said gaps being less than 3/16 inch.

7. The apparatus of claim 2, wherein said masonry-cavity-wall has a wall length and a wall height and said planar sheet is a rectangle having a sheet length and a sheet height, and wherein said height of said planar sheet is between 9 and 18 inches.

8. The apparatus of claim 2, wherein said array of rows is identically arranged on each said planar sheet and, wherein, when a first planar sheet is placed atop a second planar sheet, any one of said nodes of said second planar sheet is adapted to extend into said recess of a corresponding node on said first sheet surface of said first planar sheet such that a plurality of planar sheets is nestable one atop another.

9. The apparatus of claim 7, wherein each row contains one or more of said nodes arranged in said row such that said no e width extends substantially in a direction of said sheet length, and wherein said planar sheet is insertable in said masonry-cavity-wall such that said sheet length extends along a portion of said wall length.

10. The apparatus of claim 1, wherein said planar surfaces have two side ends and are bounded on each of said side ends respectively by a node side surface, and wherein, when extending a line from a side end of any one of said nodes in a direction substantially parallel to said node side surface, said line will intersect with said substantially planar surfaces of said node in an adjacent row.

11. The apparatus of claim 1, wherein said node tip is flattened so as to present a surface that is substantially parallel to said first sheet surface of said planar sheet.

12. The apparatus of claim 1, wherein said mesh screen is fabricated from a fibrous material and said thickness of said thin planar sheet is between one and three fibers thick.

13. A method of providing for the catching and holding of mortar and other debris falling within a cavity of a masonry wall having an inner wall and an outer wall and an intra-cavity depth that is equal to a distance between said inner wall and said outer wall, so as to allow free passage of moisture down through said cavity and out through weep holes constructed in a base of said outer wall, said method comprising:

completing a first portion of said masonry wall and incorporating weep holes into said outer wall of said masonry wall;

providing a fibrous first sheet, said fibrous first sheet having a lower horizontal edge, an upper horizontal edge, a first vertical edge and a second vertical edge, so as to have a generally planar shape interrupted by an array of isolated nodes extending out from a front side of said planar shape to a distance substantially equal to said intra-wall depth, wherein said nodes have a planar catching surface parallel to a length dimension of said first sheet and wherein said nodes are aligned in rows such that a node in one of said rows is not directly above any other one of said nodes in an adjacent row but is directly above one of said nodes in a next nearest row;

inserting said first sheet into said cavity formed between said inner wall and said outer wall of said first portion of said masonry wall in such a way that said planar shape of said first sheet extends above and across one or more of said weep holes and said length dimension of said first sheet rests on a base surface in said cavity; and completing construction of said wall;

whereby the obstruction of said weep holes is prevented.

14. The method of claim 13 wherein a second sheet identical to said first sheet is placed within said cavity such that said lower horizontal edge of said second sheet is in contact with and parallel to said upper horizontal edge of said first sheet.

15. The method of claim 13 wherein a second sheet identical to said first sheet is placed within said cavity such that said first vertical edge of said second sheet is in contact with and parallel to said second vertical edge of said first sheet.

16. The method of claim 13 wherein a second sheet identical to said first sheet is placed within said cavity such that said second sheet is spaced apart from said first sheet and extends above and across one or more of said weep holes.

* * * * *